United States Patent [19]

Turner

[11] 4,313,148

[45] Jan. 26, 1982

[54] GROUNDING APPARATUS

[76] Inventor: Robert B. Turner, 28 Courtfield Dr., Brockton, Mass. 02401

[21] Appl. No.: 142,437

[22] Filed: Apr. 21, 1980

[51] Int. Cl.[3] ..... H01H 1/04

[52] U.S. Cl. ..... 361/212; 338/220; 339/14 P; 339/14 L; 339/28; 339/38

[58] Field of Search ..... 338/220, 221, 214, 61; 361/212, 220; 339/14 P, 14 L, 28, 38

[56] References Cited

U.S. PATENT DOCUMENTS

| | | | |
|---|---|---|---|
| 2,943,242 | 6/1980 | Schaschl et al. | 361/220 X |
| 3,084,700 | 4/1963 | Fischer et al. | 361/212 X |
| 3,095,523 | 6/1963 | Stith | 361/220 |
| 3,120,414 | 2/1964 | Farish, Jr. | 339/14 R |
| 3,828,297 | 8/1974 | Hoza | 339/28 X |
| 3,914,565 | 10/1975 | Niedermeyer | 339/14 P X |

*Primary Examiner*—C. L. Albritton

*Attorney, Agent, or Firm*—Joseph S. Iandiorio

[57] ABSTRACT

A grounding apparatus including an electric plug for engaging with a conventional electric receptacle having conventional energized and grounding contacts, the plug including a grounding lug for engaging the grounding contact and one or more dummy lugs for engaging the energized contacts of the receptacle; conductor means for connection at one end with a device to be grounded; and means in the plug for interconnecting the other end of the conductor means with the grounding lug.

4 Claims, 3 Drawing Figures

GROUNDING APPARATUS

FIELD OF INVENTION

This invention relates to a grounding apparatus for capturing a ground from a conventional receptacle.

BACKGROUND OF INVENTION

Discharge from persons of static electricity in homes and offices is an annoying and a serious problem. Heart patients, for example, can be placed in jeopardy by the shock of such discharges. More recently such static discharges are interfering with proper operation of all sorts of electronic equipment which are used in increasing numbers everywhere, e.g. homes, offices, factories. For example electronic pacemakers for heart patients can malfunction due to static discharge. The discharge of static electricity by persons using electric equipment is a serious concern as it causes malfunctions of all sorts of business machines. In computers, for example, it may cause loss or alteration of data in memory, changes or errors in the computer programs, uncontrolled and unwanted printer output. Whenever people must operate equipment: point of sale terminals, bank terminals, mini and microcomputers, data entry equipment, tape and disk drives, printers; static discharge is a problem.

To attempt to overcome this problem static control devices such as floor mats for placement at the operator position in front of the machines, are offered; for example, 3M's Velostat floor mats, which are relatively inexpensive and easy to place. However, to complete installation of such devices they must be properly electrically connected to a solid ground or earth ground such as typically provided by "cold water" ground connections. Presently this usually requires an electrician's services at a substantial cost to find an earth ground and run a conductor from the ground point to the floor mat or other device to be grounded.

SUMMARY OF INVENTION

It is therefore an object of this invention to provide an improved, simple apparatus for capturing an existing ground connection.

It is a further object of this invention to provide such an apparatus which is inexpensive, easy to use, and requires no special electrical installation and can be easily engaged and disengaged by unskilled personnel.

It is a further object of this invention to provide such an apparatus which uses a conventional electrical receptacle to capture a ground connection and can be easily disconnected and reconnected for use at any location proximate a conventional receptacle.

The invention results from the realization that a good, existing, earth ground can be captured at conventional receptacles by using a dummy plug which engages the receptacle and does not tap the energized contacts but does connect with the established ground contact.

The invention features a grounding apparatus including an electric plug for engagement with a conventional electrical receptacle. The electrical receptacle has conventional grounding and energized contacts. The plug includes a grounding lug for engaging the grounding contact, and one or more dummy lugs for engaging the energized contacts of the receptacle. Conductor means connect at one end with the device to be grounded. There are means in the plug for interconnecting the other end of the conductor means with the grounding lug. The conductor means may connect directly to a terminal on the grounding lug or there may be a terminal isolated from the grounding lug to which one end of a resistor is interconnected. The other end of the resistor is interconnected with the terminal on the grounding lug, and the conductor means may be connected either directly to the grounding lug or through the resistor to the terminal or grounding lug.

DISCLOSURE OF PREFERRED EMBODIMENT

Other objects, features and advantages will occur from the following description of a preferred embodiment and the accompanying drawings, in which.

The invention may be accomplished by a grounding apparatus which includes an electric plug engaging with a conventional electrical receptacle, which has conventional grounding and energized contacts. The plug includes a grounding lug for engaging the grounding contact in the receptacle and one or more, typically two, dummy lugs typically made of insulating material for engaging the energized contacts of the receptacle. There are conduction means for connection at one end with a device to be grounded, and there are means in the plug for interconnecting the other end of the conductor means with the grounding lug. A resistor, typically of high resistance, e.g. one megohm, may be inserted either in the conductor means or in the plug so that it is in series between the grounding lug and the device to be grounded in order to prevent fatal or injurious current flow through the personnel sought to be protected. A one-megohm resistor typically discharges in approximately one second, so that the static discharge such as a mat or similar device dissipates the static charge before the person encounters the equipment. Typically there is a terminal on the grounding lug to which the conductor means can be connected. Alternatively, there may also be an isolated terminal so that a resistor may be connected between the two terminals and the conductor means can be connected either directly to the grounding lug or through the resistor to the grounding lug.

Figure 1:
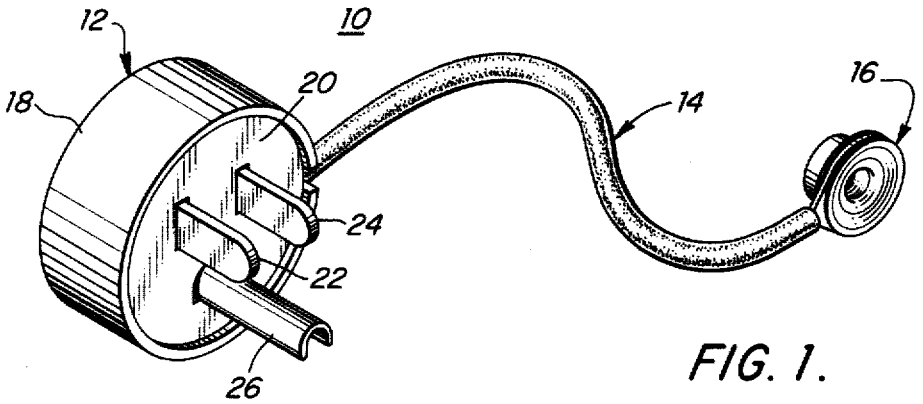
FIG. 1 is an axonometric view of a grounding apparatus according to this invention.
Figure 2:
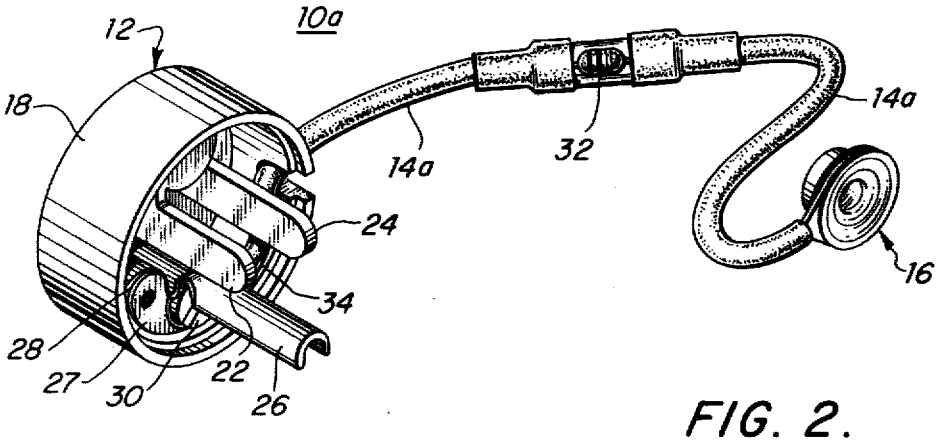
FIG. 2 is an axonometric view of a grounding apparatus similar to FIG. 1 with the plug cover removed.

There is shown in FIG. 1 a grounding apparatus 10 according to this invention including a plug 12, conductor means 14, and some interconnection element 16 for engagement with a device such as a dicharge mat or an electrical appliance. In the apparatus of FIG. 1, plug 12 consists of a plastic insulating body 18, cover 20, two plastic insulating dummy lugs 22, 24, and a metal ground lug 26. Dummy lugs 22, 24 may be formed integrally with housing 18 as shown in FIG. 2, and metal grounding lug 26 may have a tab 27 fastened to a land 28 by means of screw 30. Conductor 14*a*, which includes a series resistor 32, has one end connected to element 16 and the other end 34 connected to screw terminal 30 on grounding lug tab 27.

Figure 3:
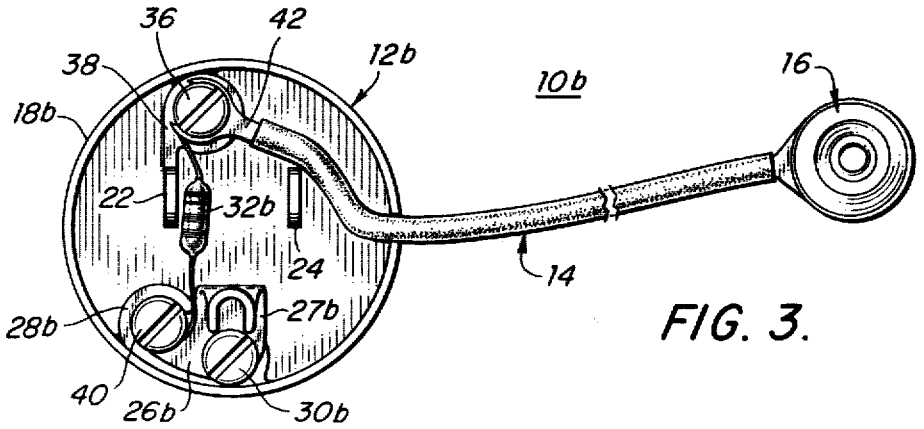
FIG. 3 is a plan view of an alternative embodiment of a grounding apparatus according to this invention.

Alternatively, grounding apparatus 10*b*, FIG. 3, may include a second terminal screw 36 threadably engaged with land 38 in housing 18*b* and electrically isolated from grounding lug 26*b*. Lug 26*b* has a terminal screw 30*b* and a second terminal screw 40 in tab 27*b*. Resistor 32*b* is interconnected between terminals 36 and 40. Thus end 42 of conductor 14 may be connected either directly to grounding lug 26*b* by engagement with terminal 30*b*, or may be connected to ground lug 26*b* through resistor 32*b* by connection with screw terminal 36, as illustrated in FIG. 3.

Other embodiments will occur to those skilled in the art and are within the following claims.

What is claimed is:

1. A grounding apparatus comprising: an electric plug for engaging with a conventional electrical receptacle having a conventional grounding contact and two energized contacts, said plug including a grounding lug for engaging said grounding contact and two dummy lugs for engaging the energized contacts of the receptacle; conductor means for connection at one end with a device to be grounded; and means in said plug for interconnecting the other end of said conductor means with said grounding lug.

2. The grounding apparatus of claim 1 in which said conductor means includes a series resistance.

3. The grounding apparatus of claim 1 in which said plug includes a terminal on said grounding lug.

4. The grounding apparatus of claim 1 including a terminal in said plug isolated from said grounding lug and a resistor interconnecting said terminal and grounding plug.

* * * * *